US007766182B2

(12) United States Patent
Trent et al.

(10) Patent No.: US 7,766,182 B2
(45) Date of Patent: Aug. 3, 2010

(54) CAP WITH THREADED GASKET VENT

(75) Inventors: Thomas C. Trent, Fort Wayne, IN (US); Jeffrey M. Grau, North Ridgeville, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 720 days.

(21) Appl. No.: 11/548,886

(22) Filed: Oct. 12, 2006

(65) Prior Publication Data

US 2007/0080130 A1 Apr. 12, 2007

Related U.S. Application Data

(60) Provisional application No. 60/725,804, filed on Oct. 12, 2005.

(51) Int. Cl.
*B65D 41/04* (2006.01)

(52) U.S. Cl. ..... 220/288; 215/307; 215/352; 220/303; 220/304; 220/366.1

(58) Field of Classification Search ..... 215/307, 215/352; 220/303, 304, 366.1, 288
See application file for complete search history.

(56) References Cited

U.S. PATENT DOCUMENTS 4,697,715 A 10/1987 Beruvides
5,292,020 A 3/1994 Narin
5,690,241 A 11/1997 Montgomery
6,679,395 B1 1/2004 Pfefferkorn et al.
6,854,614 B2 2/2005 Sprick
6,889,863 B2 5/2005 Feigel et al.
2002/0000420 A1 * 1/2002 Taha ..... 215/252

FOREIGN PATENT DOCUMENTS

GB 2151591 7/1985

* cited by examiner

*Primary Examiner*—Anthony Stashick
*Assistant Examiner*—Elizabeth Volz
(74) *Attorney, Agent, or Firm*—Renner, Otto, Boisselle & Sklar, LLP

(57) ABSTRACT

A closure cap comprises a base having at an inner side thereof an annular gland for receiving an annular seal. The annular gland has a bottom surface and an annular side surface depending from the bottom surface. A skirt depends from base and has an internal fastening thread for attaching the cap to a correspondingly but externally threaded body. Additionally, the annular side surface of the annular gland has a venting thread depending from the bottom surface of the gland to enable venting of air that may otherwise be trapped behind the annular seal when fitted in the gland. Also disclosed is a method of molding the cap.

12 Claims, 5 Drawing Sheets

CAP WITH THREADED GASKET VENT

RELATED APPLICATIONS

This application claims the benefit of U.S. Provisional Application No. 60/725,804 filed Oct. 12, 2005, which is hereby incorporated herein by reference.

FIELD OF THE INVENTION

The invention herein described relates generally to closure caps for closing an opening of a device and, more particularly, to closure caps for closing an end of a tubular member, such as a valve service port.

BACKGROUND

Caps are commonly used to close an opening of a device to protect internal components of the device or materials contained in the device. Some caps function to shield the interior components or materials from the atmosphere around them, whereas others serve to protect against the escape of an interior component or material that may harm the environment. In some instances the cap performs both functions. One example is a cap used with an air-conditioning system service valve. The cap is used to both seal the valve internal components from moisture in the environment and to protect the environment from potential leakage of refrigerant from the valve.

Caps have employed various devices to create seals, including metal-to-metal material deformation, hard gaskets, soft gaskets, etc. For soft seals, typically a gland (groove) is provided for the sealing gasket. The gland serves to locate the gasket as well as provide surfaces suitable for creating a seal with the gasket. Unfortunately, when adding a gasket to a gland in a cap, air can be trapped between the cap and the gasket. This condition is made worse when compressing the gasket to complete the seal as the volume available for the trapped air will be reduced. The trapped air, particularly when under pressure, can force the gasket out of the cap gland when the cap is unthreaded from body to which it had been attached.

SUMMARY OF THE INVENTION

The present invention provides a novel cap configuration that reduces or eliminates the trapping of air behind the seal located in a gland of a cap, without requiring difficult and expensive manufacturing procedures. A cap according to the invention is characterized by the use of a venting thread that extends into the gland for enabling the escape of air from behind the gasket and along the thread. The venting thread can be at the same pitch as the fastening thread provided for attaching the cap to a correspondingly threaded body. Consequently, when molding a plastic cap, the vent thread as well as the gland can be formed by an extension of the core used to form the fastening thread as the same pitch will allow the core and cap to be unscrewed with respect to one another. In addition, the thread peaks may act as a mechanical grip to hold the seal in the gland during handling.

Accordingly, the invention provides a closure cap comprising a base having at an inner side thereof an annular gland for receiving an annular seal. The annular gland has a bottom surface and an annular side surface depending from the bottom surface. A skirt depends from base and has an internal fastening thread for attaching the cap to a correspondingly but externally threaded body. Additionally, the annular side surface of the annular gland has a venting thread depending from the bottom surface of the gland to enable venting of air that may otherwise be trapped behind the annular seal when fitted in the gland.

The pitch of the venting thread is the same as the pitch of the fastening thread, as this enables molding of the cap without the need for a secondary operation to form the venting thread.

The annular side surface of the gland may be spaced radially from another annular side surface of the annular gland, with the annular side surfaces defining therebetween an annular space for receiving and capturing the annular seal. The venting thread may have a peak protruding into the interior of the gland for engaging the annular seal to hold the annular seal in the annular gland. The venting thread may be radially inwardly offset from the fastening threads and axially spaced from the fastening tread by an annular spacer surface.

According to another aspect of the invention, a method of forming a closure cap comprises the steps of using a mold to form the closure cap, the mold having a core member for defining internal features of the cap including a fastening thread, an annular gland for an annular seal, and a venting thread in an annular side surface of the gland that extends to a bottom surface of the gland and has the same pitch as the fastening thread; closing the mold and injecting plastic material into the mold to form the cap; and then opening the mold and relatively rotating the cap and core to unscrew one from the other.

Further features of the invention will become apparent from the following detailed description when considered in conjunction with the drawings.

BRIEF DESCRIPTION OF THE DRAWINGS

In the annexed drawings.

DETAILED DESCRIPTION

Figure 1:
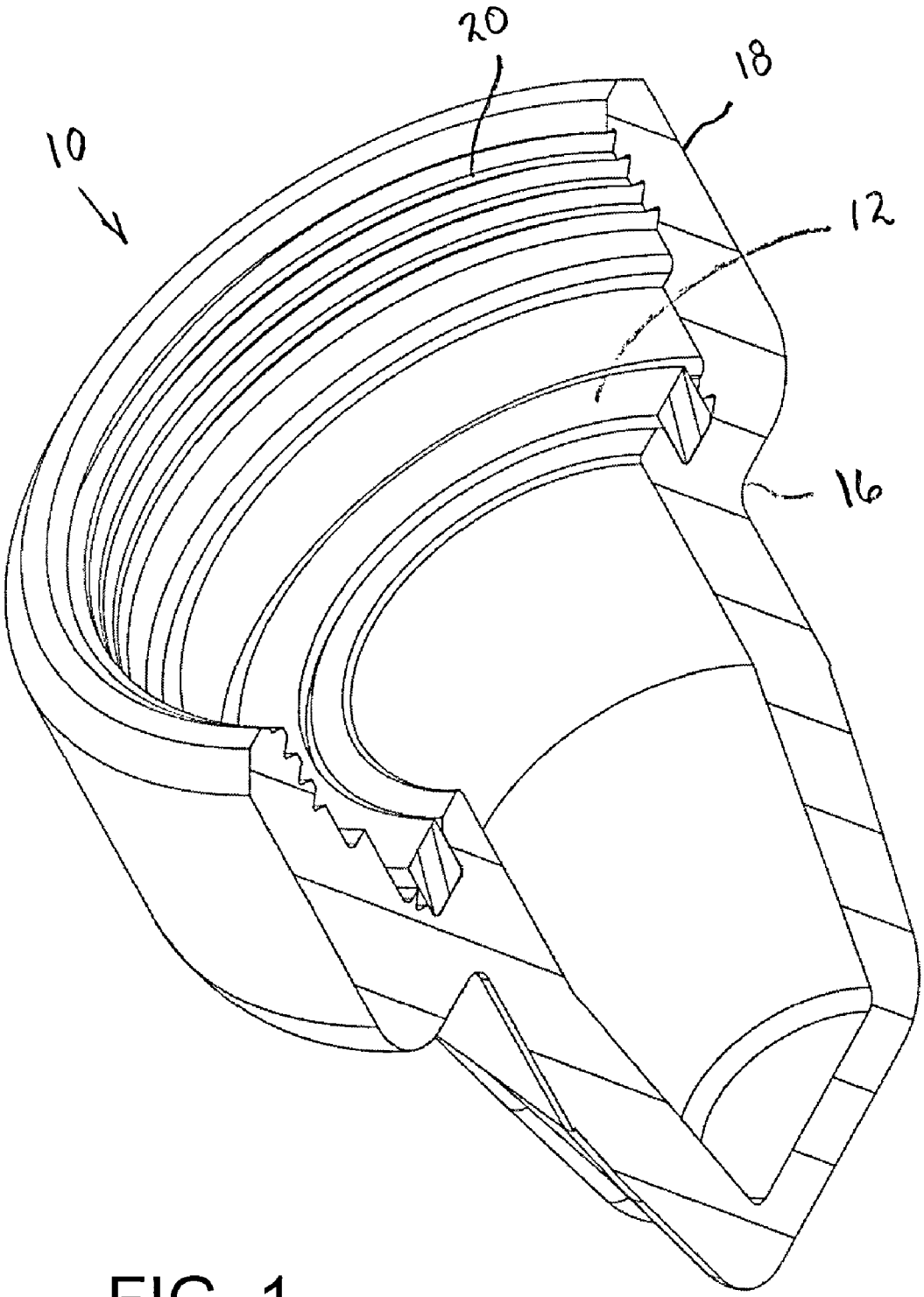
FIG. 1 is a perspective view, partly broken away in section, of an exemplary cap according to the invention.
Figure 2:
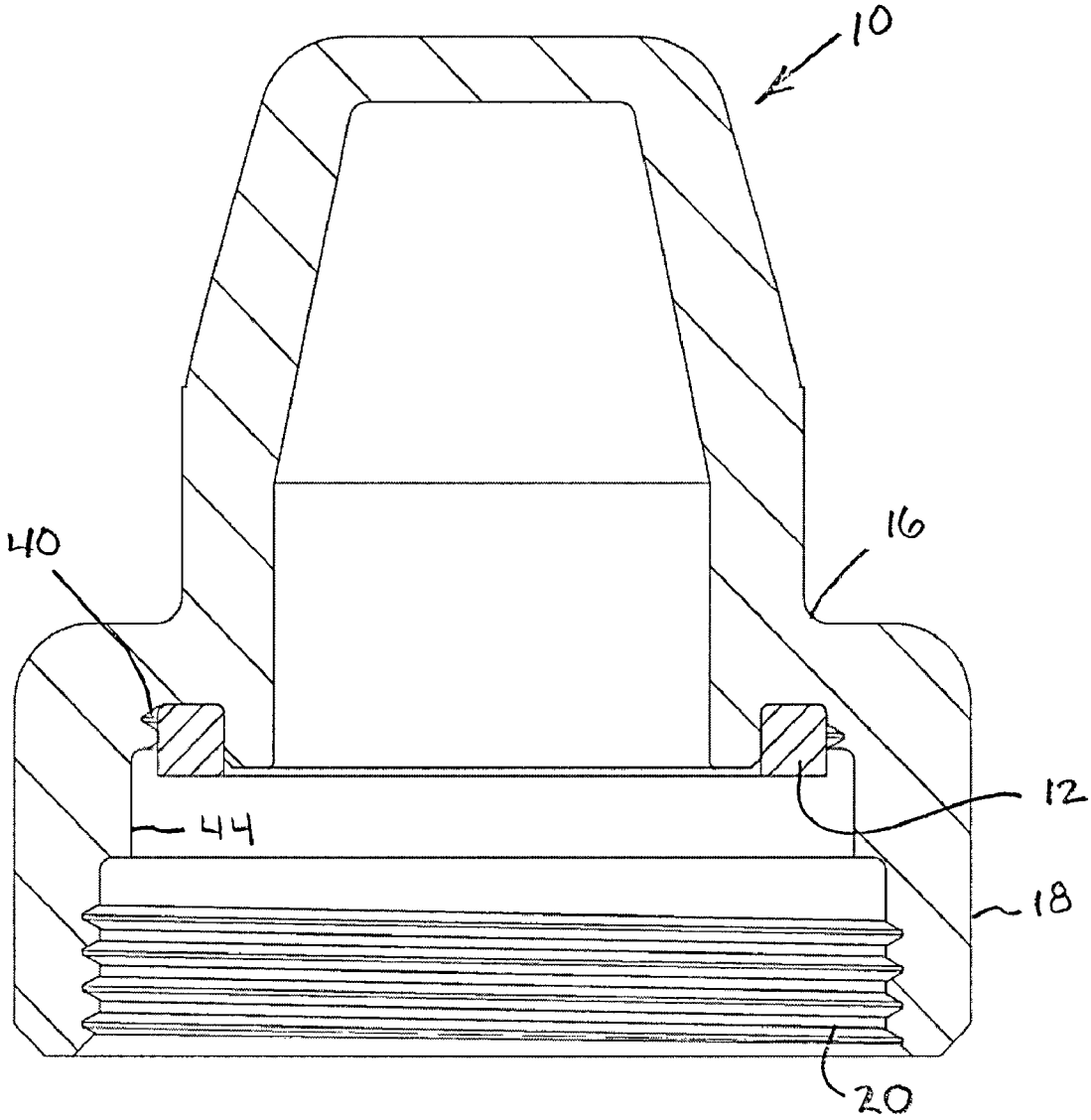
FIG. 2 is a cross-sectional view of the cap of FIG. 1.
Figure 3:
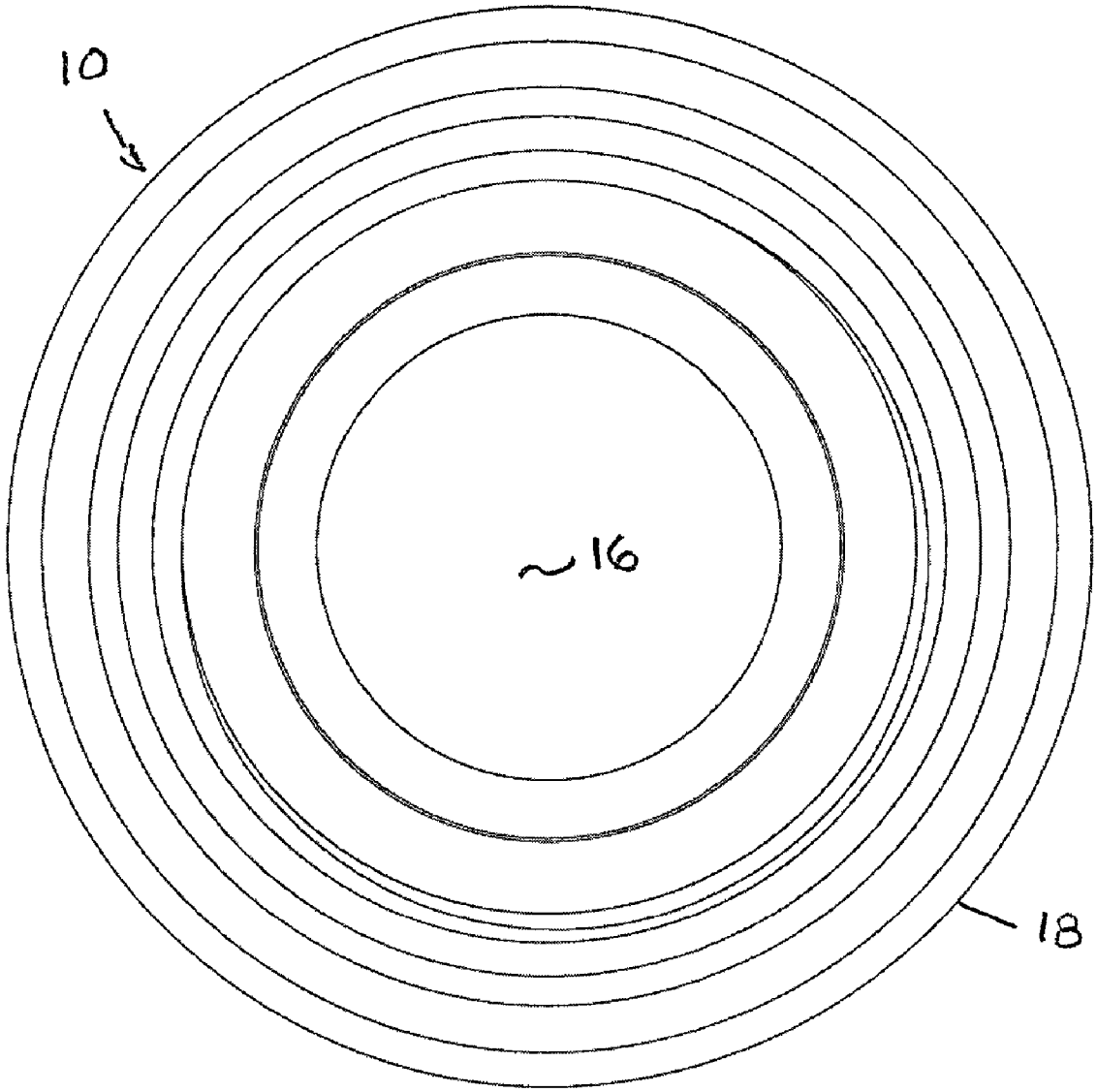
FIG. 3 is an open end view of the cap.

Referring now in detail to the drawings and initially to FIGS. 1-3, an exemplary closure cap according to the invention is indicated generally by reference numeral 10. The cap has assembled therein an annular seal 12. The cap 10 may be formed a unitary structure, preferably by molding from a plastic material.

The cap has a base 16 and a skirt 18 depending from base. The shirt has an internal fastening thread 20 (or threads if desired) for attaching the cap to a correspondingly but externally threaded body (not shown).

Figure 4:
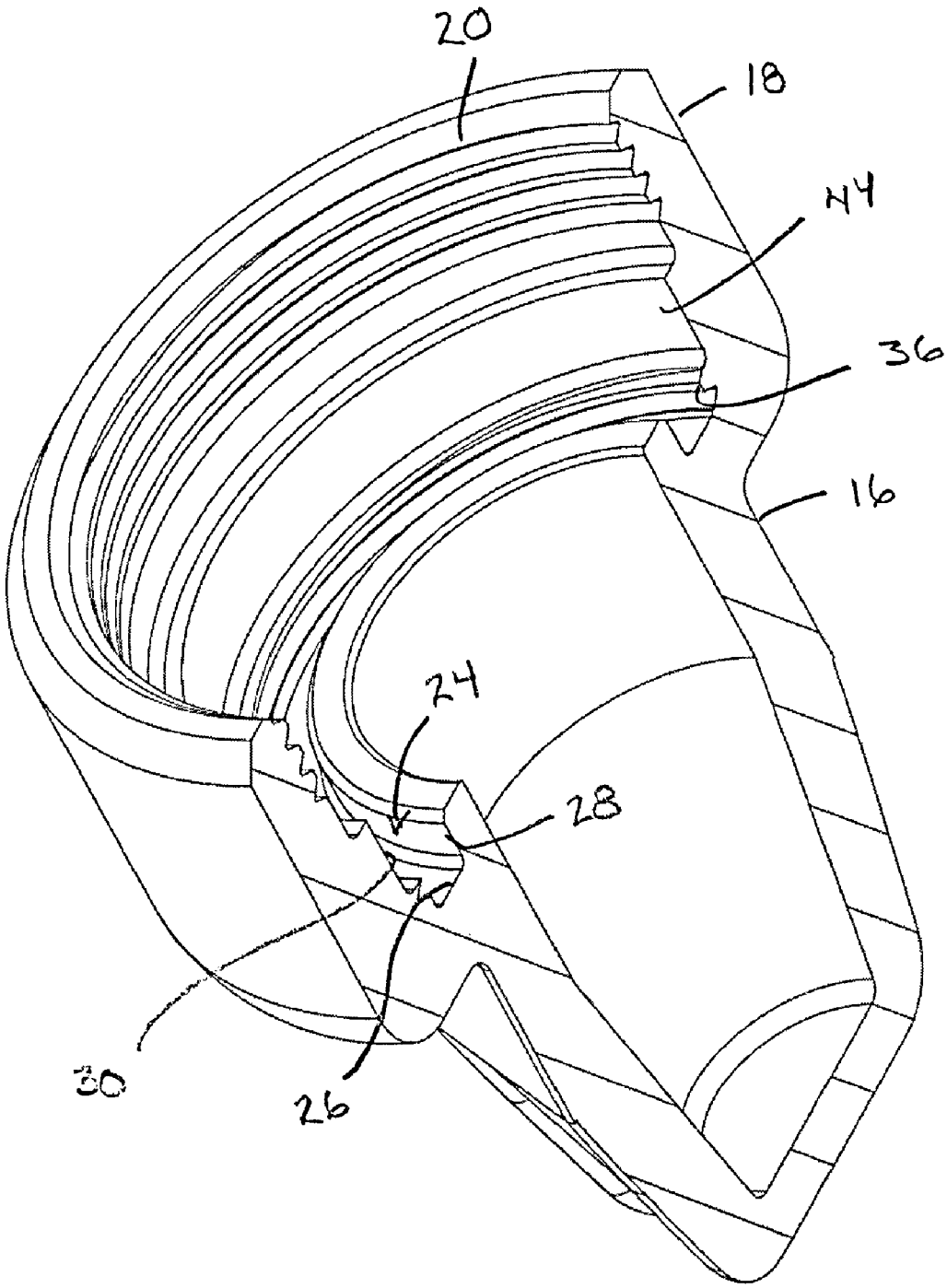
FIG. 4 is a perspective view similar to FIG. 1, but with the seal removed.
Figure 5:
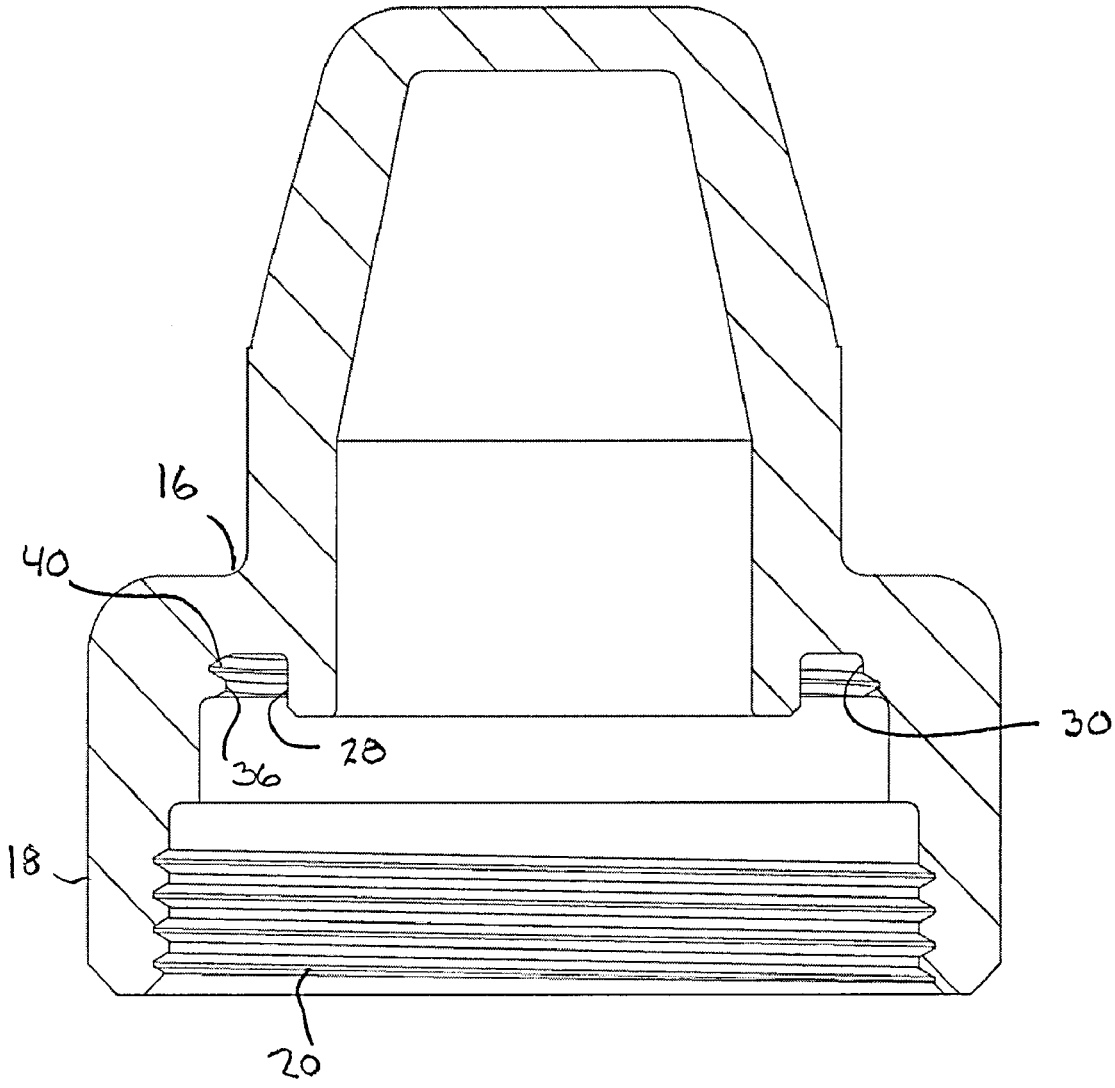
FIG. 5 is cross-sectional view similar to FIG. 2, but with the seal removed.

As best seen in FIGS. 4 and 5, the base 16 has at an inner side thereof an annular gland 24 for receiving the annular seal 12. The annular gland 24 has a bottom surface 26 and at least one annular side surface depending from the bottom surface. In the illustrated embodiment, radially spaced apart inner and outer side surfaces 28 and 30 are provided. The side surfaces define therebetween an annular space for receiving the annular seal. The inner and outer side surfaces may be substantially parallel as shown, and the annular seal may be substantially rectangular in cross-section as shown in FIGS. 1 and 2.

In accordance with the invention, the annular side surface 30 of the annular gland 24 has a venting thread 36 (or threads if desired) depending from the bottom surface 26 of the gland 24 to enable venting of air that may otherwise be trapped behind the annular seal 12 when fitted in the gland. More particularly, the thread 36 forms a helical passage 40 between the turns of the thread that extends sufficiently close to the bottom surface 26 to allow otherwise trapped air to escape through the helical passage and out of the gland 24. As will be appreciated, the venting thread will extend sufficiently away from the bottom surface of the gland to allow passage of the otherwise trapped air past the seal.

Although the helical device 36 is referred to as a thread, this does not mean such device is configured to act as a fastening thread. Rather, the function of the venting thread is to form a helical escape path for any air trapped behind the seal, as shown and described. Of course, the helical device can be fashioned as a fastening thread, and in an alternative arrangement the venting thread could be formed by a continuation of the fastening thread. In yet another arrangement, the venting thread alternatively (or even additionally) could be formed on the radially inner side surface 28 of the gland.

It also is noted that while reference is made to trapped air, that which may be trapped may be a gas other than air, such as where the cap is used in the presence of another gas. For instance, the cap may be used to seal against the escape of another gas, such as nitrogen, which may be flooding the interior of the cap when being fastened onto a threaded body such as the end of a pipe through which the gas is flowing. Consequently, such gas, rather than air, may be trapped but for the presence of the venting thread. The herein reference to air is intended to include such other gas or gasses that might be trapped, unless otherwise clearly specified.

To facilitate molding of the cap using a mold that has a core for forming internal features of the cap including the fastening thread 20, annular gland 24 and the venting thread 36, the pitch of the venting thread is the same as the pitch of the fastening thread. This allows the core and molded cap to be unscrewed with respect to one another.

As seen in FIGS. 1 and 2, the peak of the venting thread 36 may protrude into the interior of the gland 20 for engaging (biting into) the side of the annular seal 12 to hold the annular seal in the annular gland.

In the illustrated cap, the venting thread 36 is radially inwardly offset from the fastening thread 20 and axially spaced from the fastening tread by an annular spacer surface 44 which may be substantially cylindrical. The annular spacer surface may be radially inwardly offset from the fastening thread and radially outwardly offset from the venting thread.

As above mentioned, the cap may be injection molded from a plastic material in a mold having a core member for defining internal features of the cap including the fastening thread, the annular gland and the venting thread that has the same pitch as the fastening thread. After the mold is closed, plastic material may be injected into the mold to form the cap. The mold is then opened and the cap and core can be relatively rotated to unscrew one from the other.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A closure cap comprising a base having at an inner side thereof an annular gland for receiving an annular seal, the annular gland having a bottom surface and an annular side surface depending from the bottom surface; and a skirt depending from base, the skirt having an internal fastening thread for attaching the cap to a correspondingly but externally threaded body; and wherein the annular side surface of the annular gland has a venting thread depending from the bottom surface of the gland to enable venting of air that may otherwise be trapped behind the annular seal when fitted in the gland.

2. A closure cap according to claim 1, wherein the pitch of the venting thread is the same as the pitch of the fastening thread.

3. A closure cap according to claim 2, wherein the annular side surface is spaced radially from another annular side surface of the annular gland, and the annular side surfaces define therebetween an annular space for receiving the annular seal.

4. A closure cap according to claim 3, further comprising the annular seal captured in the annular gland.

5. A closure cap according to claim 4, wherein the venting thread has a peak protruding into the interior of the gland for engaging the annular seal to hold the annular seal in the annular gland.

6. A closure cap according to claim 4, wherein the annular side surfaces are substantially parallel, and the annular seal is substantially rectangular in cross-section.

7. A closure cap according to claim 1, wherein the venting thread is radially inwardly offset from the fastening thread.

8. A closure cap according to claim 7, wherein the venting thread is axially spaced from the fastening thread by an annular spacer surface.

9. A closure cap according to claim 8, wherein the annular spacer surface is radially inwardly offset from the fastening thread and radially outwardly offset from the venting thread.

10. A closure cap according to claim 9, wherein the annular spacer surface is substantially cylindrical.

11. A closure cap according to claim 1, further comprising the annular seal captured in the annular gland, and in combination with the externally threaded body onto which the cap has been screwed.

12. A closure cap according to claim 1, wherein the venting thread is not continuous with the fastening thread.

* * * * *